US010300368B1

(12) United States Patent
Jedlicka

(10) Patent No.: US 10,300,368 B1
(45) Date of Patent: May 28, 2019

(54) HOLIDAY TOSS GAME

(71) Applicant: Eileen Jedlicka, Atlanta, GA (US)

(72) Inventor: Eileen Jedlicka, Atlanta, GA (US)

( * ) Notice: Subject to any disclaimer, the term of this patent is extended or adjusted under 35 U.S.C. 154(b) by 423 days.

(21) Appl. No.: 14/599,867

(22) Filed: Jan. 19, 2015

Related U.S. Application Data

(60) Provisional application No. 62/010,666, filed on Jun. 11, 2014.

(51) Int. Cl.
*A63F 9/02* (2006.01)
*A63F 9/24* (2006.01)

(52) U.S. Cl.
CPC ..... *A63F 9/0208* (2013.01); *A63F 9/24* (2013.01); *A63F 2009/0239* (2013.01); *A63F 2009/2452* (2013.01)

(58) Field of Classification Search
CPC ..... A63F 9/0208; A63F 9/24
See application file for complete search history.

(56) References Cited

U.S. PATENT DOCUMENTS 3,026,110 A 3/1962 Hess et al.
3,170,693 A * 2/1965 Felsher ..... A63F 9/0208 273/348.3
3,421,762 A * 1/1969 Paradise ..... A63F 9/0208 211/107
3,425,694 A * 2/1969 Norris ..... A63F 9/0208 124/3
3,766,376 A * 10/1973 Sadacca ..... A47G 33/126 362/123
4,460,179 A 7/1984 Hafer
4,643,425 A * 2/1987 Herzenberger ..... A63F 5/00 273/142 B
4,736,955 A 4/1988 Pollock
4,989,880 A 2/1991 Gettemeier et al.
5,139,273 A 8/1992 Rudell et al.
RE34,461 E 11/1993 Buselli
5,452,902 A 9/1995 Foster et al.
5,626,342 A 5/1997 Foster
5,871,214 A * 2/1999 Hummel ..... A63F 9/0208 273/348.4
2015/0097338 A1* 4/2015 Abramson ..... A63F 9/0208 273/405

OTHER PUBLICATIONS http://www.belk.com/AST/Main/Belk_Primary/For_the_Home/Shop/Toys/Boys/PRD~41007076160/Tootle+Turtle+Target+Game.jsp?cm_mmc=CSE-_-Shopping-_-For_the_Shop>Toys>Boys-_-0400657052467&CA_6C15C=1378348213 (Feb. 11, 2014).

* cited by examiner

*Primary Examiner* — Eugene L Kim
*Assistant Examiner* — Jeffrey S Vanderveen
(74) *Attorney, Agent, or Firm* — Cramer Patent & Design, PLLC; Aaron R. Cramer

(57) ABSTRACT

A tossing game having a tree structure with branches that extend from a tubular post and which is vertically supported by a stand such that the tree structure can rotate. Each branch has a wire-way and an external target. A light is located on the tree structure. A control module having a counter with a preset counter number and a motor and gear assembly is attached to the tree structure. The control panel is in electrical communication with each target and with the light. The counter counts the number of times a game piece strikes a target. When the counter reaches the pre-determined number the control module lights the light. The motor and gear assembly rotate the tree structure on the stand.

20 Claims, 6 Drawing Sheets

HOLIDAY TOSS GAME

RELATED APPLICATIONS

This application claims the benefit of U.S. Provisional Application No. 62/010,666, which was filed Jun. 11, 2014, the entire disclosures of which are incorporated herein by reference.

FIELD OF THE INVENTION

The presently disclosed subject matter is directed to games that use tossed playing pieces. More particularly, it is directed to a game in which projectiles are tossed towards a Christmas tree having targets situated along its branches.

BACKGROUND OF THE INVENTION

Older people often remember with great fondness the games of their youth. Neighborhood children would often play tag, board games, baseball, badminton, horseshoes, and darts. Family gatherings such as at different holidays, particularly around Christmas, would often result in different games being played by family members. While some of those games are still played they are not as popular today as they once were.

One (1) reason for the decline in popularity of older games is that today's children are influenced by fast action computer games, movies, and other activities that incorporate both sound and light effects. While such sensory inputs have their place in game playing other factors can influence the enjoyment of a particular game. For example, some of the older games combined elements of both player competition and player skill in ways that are often impossible to replicate on a computer.

One (1) type of older game playing involved tossing game pieces (projectiles) towards a target. This was often similar to basketball where a successful toss occurred when the projectile found its target and which resulted in a score. Similar to darts, by providing multiple target locations at different points could increase the competition and skill and could be used to determine who won a particular game. Many variations of games, projectiles, and scoring can be found in the prior art.

For example, a high score, the first to a score, the first to accumulate a given score as well as multiple other possibilities were all possible.

Since modern games with their stimulating sights and sounds as well as the older games with their competition based on a player's skill both have valuable aspects, a new game in which combines the two (2) would be beneficial. Beneficially such a game would be well suited for play by families and friends around holidays. Preferably such a game would have a Christmas theme.

SUMMARY OF THE INVENTION

The principles of the present invention provide for a Holiday based skill game using tossed game pieces. Those principles enable competition based on a player's skill and which rewards the winner with a visual reward.

A tossing game that is in accord with the present invention includes a tree structure having branches that extend from a tubular post, each branch having a wire-way and an external target and a tree stand that vertically supports said tree structure such that the tree structure can rotate. A light is located on the tree structure. Also included is a control module having a counter with a preset counter number. The control panel is in electrical communication with each target and with the light. The tossing game further includes at least one game piece that is configured to attach to each target upon contact. The counter counts the number of times a game piece strikes a target, and when the counter reaches the pre-determined number the control module lights the light.

In practice the tree structure can resemble a Christmas tree. Also in practice the target captures the game piece when the game piece is tossed into contact with the target. To that end the target includes a fastener such as a hook-and-loop fastener for capturing the game piece. The target beneficially includes a magnetic plate and if it does a magnetically-operated switch. In that case the game piece includes a magnet embedded within a core such that when the game piece is captured the magnet operatively communicates with the plate and with the switch to operate the switch. The switch might be a magnetically-operated relay or a Hall-effect sensor. The game piece may include a hook-and-loop fastener.

The control module preferably includes a housing, a power source within the housing, a selector switch for setting the preset counter number; and a power switch for controlling power from the power source to the light, to each target, and to the control module. Beneficially the housing is attached to the post and the housing further houses a motor that is operatively connected to the power source via the power switch.

To assist rotation a bearing is disposed between the post and the stand. The motor turns at least one (1) gear which causes the post to rotate on the stand. The stand includes a female socket that receives a gear shaft on which the at least one (1) gear turns. Preferably the tree structure can be removed from the stand by separating the gear shaft from the female socket.

The control module beneficially receives electrical power from an AC outlet, the power source is a rechargeable battery, and the control module recharges the battery using electrical power received from the AC outlet.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
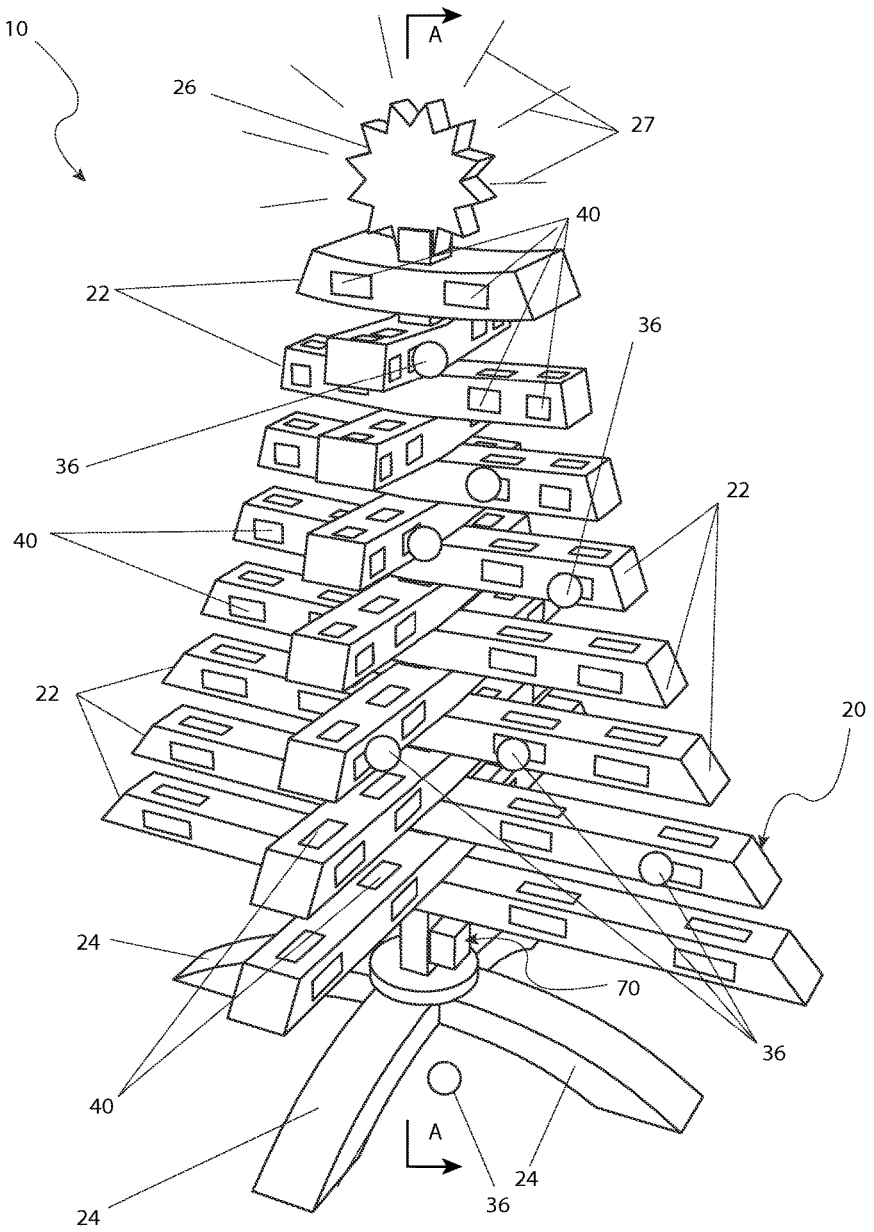
FIG. 1 is a front perspective view of a Holiday tree toss game 10 according to a preferred embodiment of the present invention.

10 holiday toss game
20 tree structure
22 branch
23 wire-way

24 stand
25 socket
26 lamp
27 illumination
28 post
29 conduit
36 game piece
37 core
38 magnet
40 target
41*a* first hook-and-loop fastener
41*b* second hook-and-loop fastener
42 plate
44 target switch
45 wiring
46 connector
70 control box
71 housing
72 battery
74 thrust bearing
78 control module
80 power switch
82 selector switch
84*a* receptacle
84*b* jack
85 power cord
90 motor
91 motor shaft
93 first gear
94 second gear
96 second gear shaft
97 bushing
98 keyed end
105 outlet

DETAILED DESCRIPTION OF THE PREFERRED EMBODIMENT

The preferred embodiment of the present invention is depicted within FIGS. 1 through 6. However, the invention is not limited to what is specifically illustrated and described. A person skilled in the art will appreciate that many other embodiments of the invention are possible without deviating from the basic concept of the invention. Any such work around also falls with the scope of this invention.

The terms "a" and "an" herein do not denote a limitation of quantity, but rather denote the presence of at least one (1) of the referenced items. In addition, unless otherwise denoted all directional signals such as up, down, left, right, inside, outside are taken relative to the illustration shown in FIG. 1.

Referring now to FIG. 1, the present invention describes a tree toss game 10 which provides a three-dimensional rotating tree structure 20 having a plurality of targets 40 that are positioned along tree branches 22. During play a user tosses game pieces 36 in an attempt to have the game pieces 36 stick to the targets 40. The game pieces 36 are envisioned as being generally spherical projectiles which resemble tree ornaments and which have a mating surface that sticks to the targets 40. In use the number of attached game pieces 36 is electronically counted until a pre-selected number of attached game pieces 36 are obtained. When that number is reached a top mounted lamp 26 emits illumination 27 which signals the end of the game and which provides a visual award.

Figure 2:
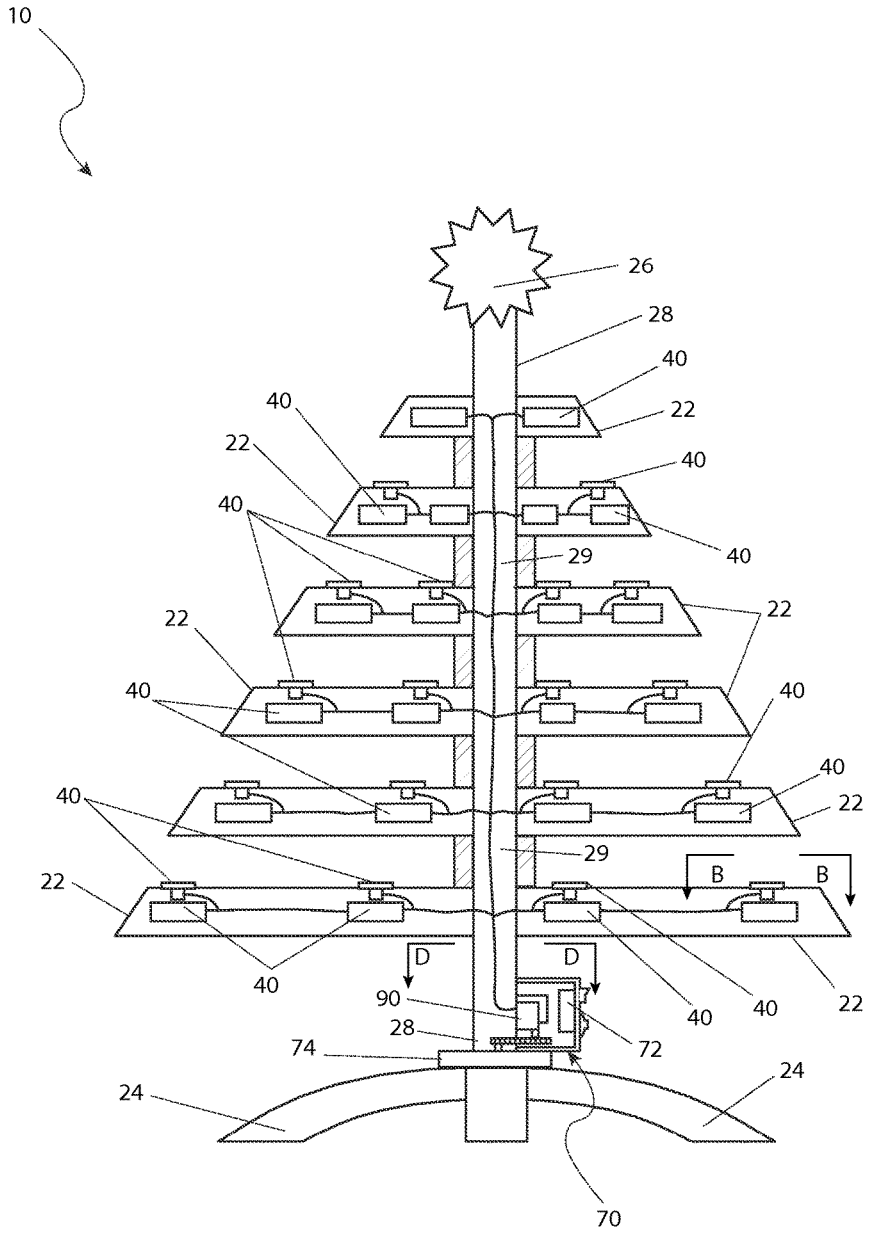
FIG. 2 is a sectional view of the tree toss game 10 taken along section line A-A of FIG. 1.

Refer now respectively to FIGS. 1 and 2 for front perspective and sectional views of the tree toss game 10. The tree toss game 10 tree structure 20 includes a plurality of branches 22, a stand 24, a lamp 26, and a central post 28. The branches 22, which may be straight or arcuate, extend outward from the central post 28 to produce a tree structure 20 that resembles an evergreen tree or some other tree. It is envisioned that the tree structure 20 will be approximately twenty-four inches (24 in.) high. However, the tree structure 20 could be introduced in various widths and heights and with various external colors and patterns.

The tree structure 20 provides a plurality of outwardly extending and stacked branches 22 which can freely rotate around the axis of the central post 28. The central post 28 takes the form of a vertical tube having a conduit 29 that is described in more detail subsequently. It should be understood that the tree structure 20 may take on various other shapes such as, but not limited to: conical, pyramidal, tiered, and others. The branches 22 are envisioned being made of wood, aluminum, composite plastic, or the like.

The tree structure 20 is rotatably mounted upon the stand 24. The stand 24 provides a rotary motion to the post 28 and branch 22 using a motor 90 (described in more detail subsequently). The stand 24 is envisioned as being a four-legged, stabilizing structure made of similar materials as the branches 22 and which provides secure positioning of the tree structure 20 upon a floor.

Each branch 22 preferably has a rectangular cross-section and a plurality of targets 40 located along its top and side surfaces. Each target 40 has a plurality of fasteners 41*a* that are bonded to the surface of the branch 22 using an adhesive or an equivalent means. The first fasteners 41*a* mechanically arrest and capture tossed game pieces 36 upon contact. Each game piece 36 is correspondingly covered by a bonded second fastener 41*b*. Each target 40 further includes internal electrical components that sense and communicate when a game piece 36 becomes attached to the target 40 (see FIGS. 3 and 4). In the preferred embodiment the first fasteners 41*a* and the second fasteners 41*b* are mating hook-and-loop-type fasteners.

Figure 3:
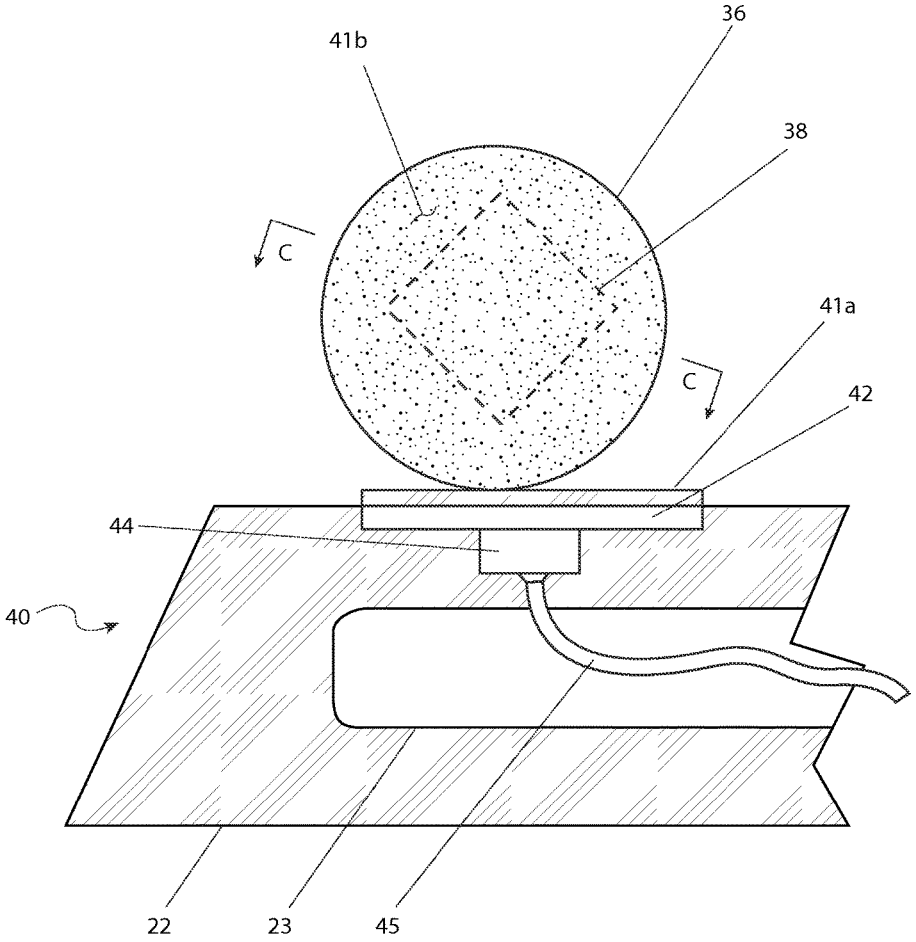
FIG. 3 is a close-up sectional view of a game piece 36 and a target 40 taken along section line B-B of FIG. 2.
Figure 4:
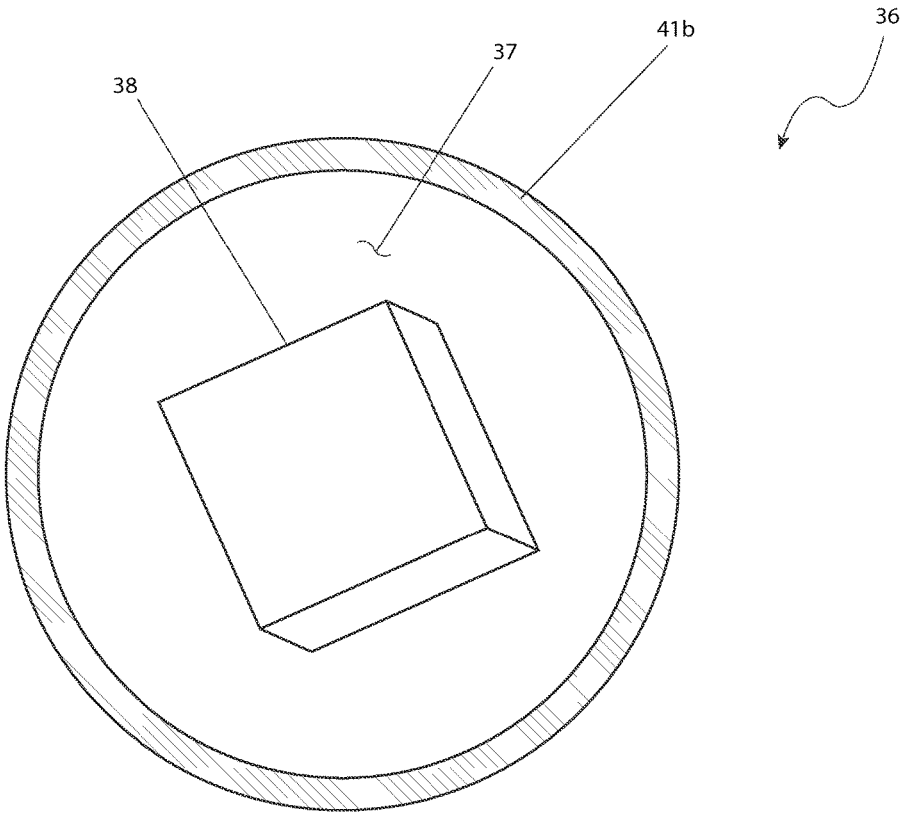
FIG. 4 is a sectional view of a game piece 36 taken along section line C-C of FIG. 3.

Refer now respectively to FIGS. 3 and 4 for close-up and sectional views of a game piece 36 that is captured by a target 40. Each target 40 electrically responds to a magnetic field produced by a permanent magnet 38 embedded within each game piece 36.

Each target 40 has a metal plate 42, a target switch 44, and interconnecting wiring 45. The metal plate 42 is a thin section of ferrous-metal stock preferably having a rectangular outline and beneficially positioned subjacent to the first fastener 41*a*. Attached to the metal plate 42 is a target switch 44 which is centered along the bottom surface of the plate 42. Upon attachment of a game piece 36 the magnet 38 within the game piece 36 magnetically excites the plate 42 which in turn excites the target switch 44 to complete a sensing circuit.

The target switch 44 is envisioned as being an electromagnetic switch such as a Hall-effect sensor, a magnetically-operated reed switch, or some similar magnetically switched device capable of producing a signal such as by completing a circuit to cause current to flow. That flow current passes through the target switch 44 and the interconnecting wiring 45 to a control box 70 (see FIGS. 1,2 and 5) located at a bottom end of the post 28. Each branch 22 has a hollow center wire-way 23 for routing wiring 45 from each target switch 44 to the post 28 and from there downward through a hollow center conduit 29 of the post 28 to the control box 70 (see FIG. 5).

Referring now to FIG. 4, the tree toss game 10 is envisioned as having a plurality of game pieces 36. Each game piece 36 is envisioned as being generally spherical in shape and resembling a tree ornament or a similar figurine. Each game piece 36 has a solid core 37 envisioned as being made of rigid polystyrene or a similar light-weight but rigid polymer. The core 37 is covered by the second fastener 41*b* and has an integrally-molded permanent magnet 38 located in its center. The magnet 38 must be of a sufficient size and magnetic strength to excite the aforementioned target switch 44.

Figure 5:
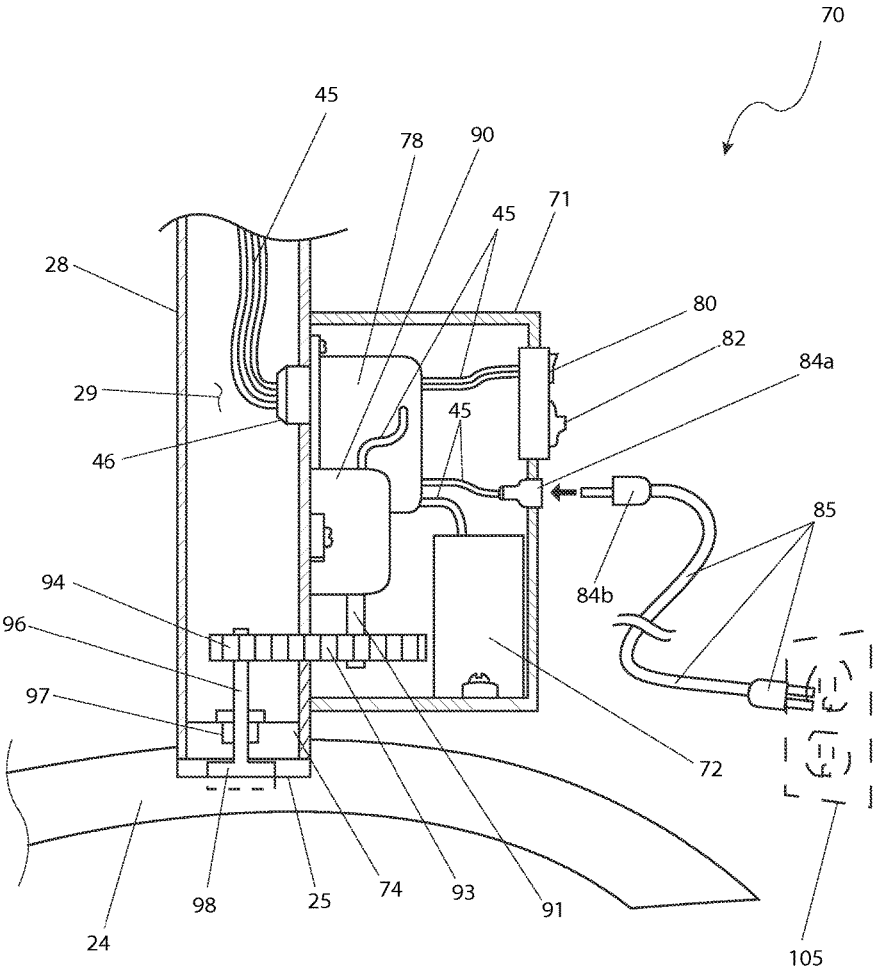
FIG. 5 is a sectional drawing of a control box 70 taken along section line D-D of FIG. 2.
Figure 6:
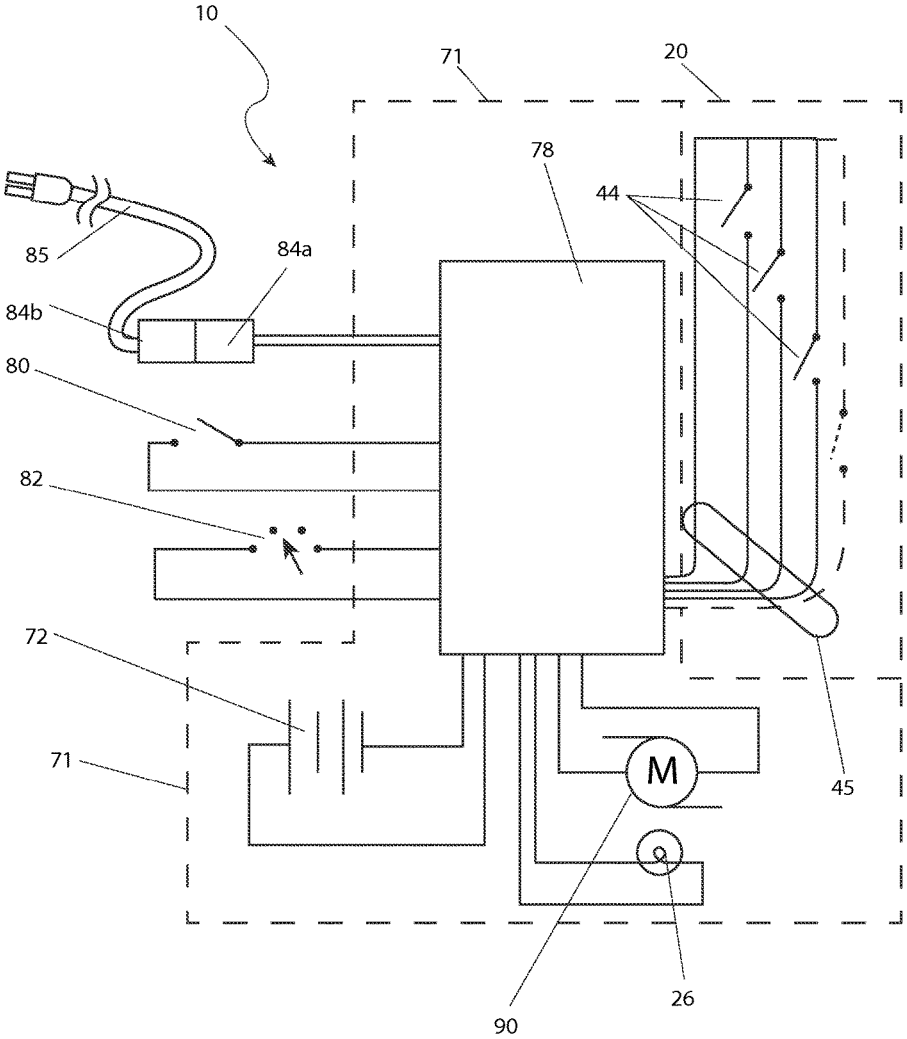
FIG. 6 is an electrical block diagram of the tree toss game 10 shown in FIG. 1.

Refer now respectively to FIGS. 5 and 6 for a sectional drawing of a control box 70 and for an electrical block diagram of the tree toss game 10. The control box 70 includes a rectangular or cylindrical housing 71 that contains all necessary electrical and electronic equipment for the aforementioned targets 40 and the operation of the tree toss game 10, including causing the tree structure 20 to rotate. The housing 71 provides a protective enclosure for a rechargeable battery 72, a control module 78, and a motor 90. The control module 78 contains various electrical and electronic components including circuit boards, microprocessors, relays, embedded software, and input/output (I/O) processing capability, which processes and energizes the tree toss game 10.

The housing 71 supports a mounted externally accessible power switch 80 that is used to energize the tree toss game 10, a selector switch 82, and a power receptacle 84*a* for recharging the battery 72. The control module 78 is in electrical communication with the battery 72, the motor 90, the power switch 80, the selector switch 82, and the power receptacle 84*a* via a plurality of interconnecting wiring 45.

As previously noted, wiring from the target switches 44 is routed through the conduit 29 of the post 28 and is then connected to the control module 78 via a multi-conductor connector 46. The control module 78 includes hardware and software to monitor each circuit of each target switch 44 to obtain a total number of targets 40 which are occupied by an affixed game piece 36. The selector switch 82 allows a user to pre-select a specific number of attached game pieces 36 required to cause illumination 27 of the lamp 26 (see FIG. 1).

The battery 72 provides power to the control module 78 and to the motor 90. The battery 72 is charged as required by plugging a jack portion 84*b* of a power cord 85 into the receptacle 84*a*. Power from the power cord 85 is envisioned as being regulated by the control module 78 to deliver the correct charging voltage to the battery 72. The jack 84*b* is envisioned as being an integral part of the power cord 85, which is to be plugged into an outlet 105 during charging of the battery 72 (see FIG. 1).

Power from the battery 72 is directed to the motor 90 by a relay or other switch in the control module 78 when a user presses the power switch 80 to the "ON" position. The motor 90 then provides a torque which results in a rotary motion between the tree structure 20 and the subjacent stand 24 via pair of spur gears including a first gear 93 and a second gear 94. The first gear 93 is mounted to the motor shaft 91 of the motor 90, while the second gear 94 is mounted to a second gear shaft 96. An interlocking keyed end 98 of the second gear shaft 96 engages a mating female socket 25 formed or machined into a top center surface of the stand 24 to position the second gear shaft 96 along a vertical center line of the post 28 in a stationary manner. A thrust bearing 74 is annularly affixed to the exterior of the second gear shaft 96. The bottom end of the post 28 is attached to the thrust bearing 74, such as by a press-fit-type connection, thereby enabling rotating engagement between the thrust bearing 74 and the bushing 97, and subsequently enabling the post 28 to be freely rotate relative to the second gear shaft 96 and stand 24. Upon energizing the motor 90, the gears 93, 94 act to rotate the tree structure 20, thereby providing a more challenging game experience.

The tree structure 20 may be easily removed from the stand 24 for compact packaging or storage by lifting and detaching the thrust bearing 74 and the keyed end 98 of the second gear shaft 96 from the socket 25.

It is to be understood that various other structures can be used to rotate the tree structure 20, such as belt drives, various other types of gear drives, ratcheting mechanisms, mechanical spring mechanisms, as well as mounting the motor 90 and associated drive components in other locations.

The preferred embodiment of the present invention can be utilized by the common user in a simple and effortless manner with little or no training. After initial purchase or acquisition of the tree toss game 10 it would be installed as indicated in FIG. 1.

The method of installing and utilizing the tree toss game 10 may be achieved by performing the following steps: procuring a model of the tree toss game 10 having a desired size, color, branch design, and external shape; removing the stand 24 from the provided packaging; placing the stand 24 on a floor surface at a suitable location; removing the tree structure 20 from the packaging; inserting the thrust bearing 74 and keyed end 98 of the tree structure 20 into the socket 25 of the stand 24; pivoting the branches 22 about the post 28 until obtaining a desired three-dimensional shape; charging the battery 72 by plugging the jack 84*b* into the receptacle 84*a*; plugging the power cord 85 into a wall outlet 105; waiting a period of time for the battery 36 to be fully charged; unplugging the jack 84*b* and power cord 85; using the selector switch 82 to select a desired number of affixed game pieces 36 to cause the lamp 26 to illuminate 27 and end the game; energizing the targets 40 and the motor 90 to rotate the tree structure 20 by pressing the power switch 80 to the "ON" position; allowing the tree structure 20 to rotate while playing the game; throwing and affixing a plurality of game pieces 36 upon the targets 40 located upon the branches 22 via respective hook-and-loop fastener portions 41*a*, 41*b*; allowing the control module 78 to count the affixed game pieces 36 via switching of the target switches 44; throwing and attaching game pieces 36 upon the targets 40 until obtaining the pre-set number of affixed game pieces 36, as indicated upon the selector switch 82; allowing the control module 78 to subsequently illuminate 27 the lamp 26 to end the game; and, benefiting from a decorative and fun toss game 10 afforded a user of the tree toss game 10.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A game piece tossing game, comprising:

a tree structure having branches that extend from a tubular post, each branch having a hollow wire-way and an external target having a plate and a switch;

a tree stand for vertically supporting said tree structure in a manner such that said tree structure can rotate;

a light on said tree structure; and, a control module having a counter with a preset counter number, said control panel in electrical communication with each target and with said light;

wherein said game piece is configured to attach to each target;

wherein said counter counts the number of times said game piece strikes a target; and, wherein said control module lights said light when said counter reaches the pre-determined number.

2. The game piece tossing game according to claim 1, wherein said tree structure resembles a Christmas tree.

3. The game piece tossing game according to claim 1, wherein said target captures said game piece.

4. The game piece tossing game according to claim 3, wherein said target includes a fastener for capturing said game piece.

5. The game piece tossing game according to claim 4, wherein said fastener is a hook-and-loop fastener.

6. The game piece tossing game according to claim 1, wherein said plate is magnetic.

7. The game piece tossing game according to claim 6, wherein said switch is a magnetically operated.

8. The game piece tossing game according to claim 7, wherein said game piece includes a magnet embedded within a core; and wherein said magnet operatively communicates with said plate and with said switch to operate said switch.

9. The game piece tossing game according to claim 7, wherein said switch is a magnetically operated relay.

10. The game piece tossing game according to claim 7, wherein said switch is a Hall-effect sensor.

11. The game piece tossing game according to claim 1, wherein said control module includes:

a housing;

a power source within said housing;

a selector switch for setting said preset counter number; and, a power switch for controlling power from said power source to said light, to each target, and to said control module.

12. The game piece tossing game according to claim 11, wherein said housing is attached to said post.

13. The game piece tossing game according to claim 12, wherein said housing further houses a motor operatively connected to said power source via said power switch.

14. The game piece tossing game according to claim 13, further including a bearing disposed between said post and said stand.

15. The game piece tossing game according to claim 14, wherein said motor turns at least one gear which causes said post to rotate on said stand.

16. The game piece tossing game according to claim 15, wherein said stand includes a female socket that receives a gear shaft on which said at least one gear turns.

17. The game piece tossing game according to claim 16, wherein said tree structure can be removed from said stand by separating said gear shaft from said female socket.

18. The game piece tossing game of claim 11, wherein said control module receives electrical power from an AC outlet.

19. The game piece tossing game of claim 18, wherein said power source is a rechargeable battery.

20. The game piece tossing game of claim 19, wherein said control module recharges said battery using electrical power received from said AC outlet.

* * * * *